United States Patent [19]

Cannan et al.

[11] Patent Number: 4,742,652

[45] Date of Patent: May 10, 1988

[54] AIR RESTRAINT DEVICE FOR BURNISHING MACHINE

[75] Inventors: Bernard M. Cannan, Wheaton; Richard C. Mulhall, Lisle, both of Ill.; Fredrick B. Brown, Elkhart; Martin E. Wiese, South Bend, both of Ind.

[73] Assignees: ServiceMaster Co L.P.; National Union Electric Corporation, both of Downers Grove, Ill.

[21] Appl. No.: 40,273

[22] Filed: Apr. 20, 1987

[51] Int. Cl.[4] ..... B24B 23/02

[52] U.S. Cl. ..... 51/177; 15/49 R; 15/98; 15/246

[58] Field of Search ..... 51/177, 174, 170 R, 51/170 T; 15/49 R, 50 R, 98, 246

[56] References Cited

U.S. PATENT DOCUMENTS 2,301,164 11/1942 Mall ..... 51/177
3,733,635 5/1973 Carden ..... 15/49 R
4,330,897 5/1982 Tucker et al. ..... 51/177
4,631,775 12/1986 Palmer et al. ..... 15/98

FOREIGN PATENT DOCUMENTS 1286825 1/1962 France ..... 51/177

*Primary Examiner*—Roscoe V. Parker
*Attorney, Agent, or Firm*—Allegretti, Newitt, Witcoff & McAndrews, Ltd.

[57] ABSTRACT

A high speed floor burnishing machine in which fine particles generated by the burnishing action are confined, having a burnishing disc which is completely enclosed in a housing. The housing has a peripheral domed flange terminating in a sponge rubber skirt in contact with the floor, and is mounted to float in response to unevenness in the floor level. The weight of the housing compresses the skirt to the extent of 0.19 to 0.25 pounds per linear inch of skirt circumference to seal the enclosure. In one form of the invention the housing floats on a pair of sleeves surrounding bolts screwed into the base of the machine. In another form the housing is suspended from a flexible diaphragm surrounding the drive shaft.

12 Claims, 4 Drawing Sheets

AIR RESTRAINT DEVICE FOR BURNISHING MACHINE

This invention relates to an ultra high speed (1000–3000 rpm range) rotary burnishing machine for polishing hard surfaced floors. More particularly, it relates to such a machine in which the rotating pad is completely enclosed in a housing so that air and particles are prevented from passing into or out of the enclosed space. The particles generated in the burnishing procedure are thus confined within the housing and cannot escape into the air. The adverse effects of ultra high speed floor burnishing on air quality in health care facilities is reported in Vol. 7, No. 10 of *INFECTION CONTROL*, pages 501–505 (Oct. 1986).

PRIOR ART

U.S. Pat. No. 4,330,897 issued May 25, 1982 shows a rotary floor cleaning machine having a fiberglass splash guard over the disc comprising a cylindrical member with a side wall. The splash guard is urged toward the floor by coil springs, which also permit the guard to shift laterally in case it strikes an obstruction. At the rear, the guard is cut out to receive a bracket. In accordance with the patent specification, the guard is used to confine water used in wet stripping.

This cleaning machine has no resilient skirt and because the guard is rigid, it does not conform to unevenness in the floor being stripped. Also, the space around the rotating disc is not completely enclosed because of the opening at the rear of the guard. Consequently, the guard is strictly a "splash" guard and will not confine the air.

It has also been disclosed previously to provide an ultra speed burnishing machine with a resin bonded fiber skirt surrounding the rotating disc which skirt engages the floor. This material is not impervious and permits air to flow into and out of the space around the disc. The fiber skirt does not wear well and has a tendency to snag and tear away. It wears at an excessive rate.

U.S. Pat. No. 3,733,635 shows a scrubbing machine with a splash guard to confine dirty water, which is made from flexible waterproof acid resisting material. Like the housing of U.S. Pat. No. 4,330,897 the enclosure is not complete. It is open at the back.

U.S. Pat. No. 4,631,775 shows a high speed burnishing machine with a shroud which surrounds the rotating driving assembly and burnishing disc. In this machine, there are fins on the rotating hub of the driving assembly which act as radial fan blades to draw air into the enclosing shroud through an opening at the top of the shroud creating a positive pressure with the intent of forcing the air out under pressure through a duct at the rear of the shroud; thence, through a bag filter which is intended to capture entrained debris from within the shrouded area. The lower edge of the enclosing shroud has a flexible lip attached to it which slides along the floor as the burnisher is operated, the lip being forced against the floor by spring loaded fasteners which secure the shroud to the underside of the motor mounting frame. The flexible lip must be pressed against the floor with enough downward force to withstand the outwardly directed pressure of the turbulent air coming off the rapidly turning disc driver and disc (up to 130 mph). The filter bag must be restrictive to retain particles down to 0.3 micro (a size typical of potentially harmful microorganisms) yet have sufficient flow characteristics to allow uniform passage of the pressurized air for practical lengths of time without partially clogging or fully clogging, thus causing pressure buildup beyond the tolerance of the downwardly forced lips of the shroud.

SUMMARY OF THE INVENTION

Abrasive discs used under ultra high speed burnishing machines (1000–3000 rpm) generate fine particles which consist of floor finish, dust and microorganisms, as the disc rotates in contact with the floor. It is desirable to confine the particles within the machine. If there are openings or a gap between the floor surface and the lower rim of the housing surrounding the spinning disc, air in the housing will be expelled peripherally outwards by the rapidly rotating disc. The fine particles become entrained in the air and are carried into the room. By closing off the peripheral gap between the floor and the housing, the air flow, including the entrained particles within the housing, is interrupted. The majority of said particles remain on the floor from which they can be vacuumed or mopped up. Remaining particles settle on the internal sides of the housing and are physically wiped or vacuumed away from time to time. It is also critical to seal the opening at the upper center of the enclosure, where the motor shaft enters, to stop the flow of air into the enclosure since the rapidly rotating driving assembly and burnishing pad act like the impeller of a centrifugal fan or pump. In hospitals and similar institutions where sick or older persons are present, particulate material in the air can be harmful to the patients. In commercial areas air borne dust is a concern to delicate equipment and constitutes a nuisance.

In accordance with the invention, the ultra speed burnishing machine is equipped with a separate housing suspended from the frame or base which completely encloses the rotating driving assembly and burnishing disc or pad. The housing is mounted to "float" as the machine traverses uneven areas of the floor being polished. A closed cell sponge rubber skirt depends from the housing and is in contact with the floor, thus restraining the flow of air outwardly. Preferably, the floating housing has sufficient weight to keep the rubber skirt in contact with the floor at all times, thus requiring no spring loading or other force-providing means. A flexible sealing membrane attaached to both "floating" housing and machine base prevents air from being drawn in. Were it not for this top sealing membrane, the weight necessary to restrain outflowing air around the bottom sealing ring and the floor would be so great as to make the floor machine intolerably difficult to push or pull across the floor.

In a preferred form of the invention the machine is supported by a pair of fixed wheels at the rear and two swivel casters at the front to make the machine highly maneuverable. The casters are mounted on the ends of arms which are pivotally linked to the base of the machine and are vertically adjustable with respect thereto.

DRAWINGS

These and other advantages of the machine will become apparent from the following description when read in conjunction with the accompanying drawings in which.

DETAILED DESCRIPTION

The burnisher described below is an adaptation of the KF2000E High Speed Floor Machine manufactured by the Kent Company of Elkhart, Ind. Certain standard parts of this machine have been replaced with specialized parts which are necessary to proper functioning of the burnisher of the invention and the separately suspended weighted enclosure.

Figure 1:
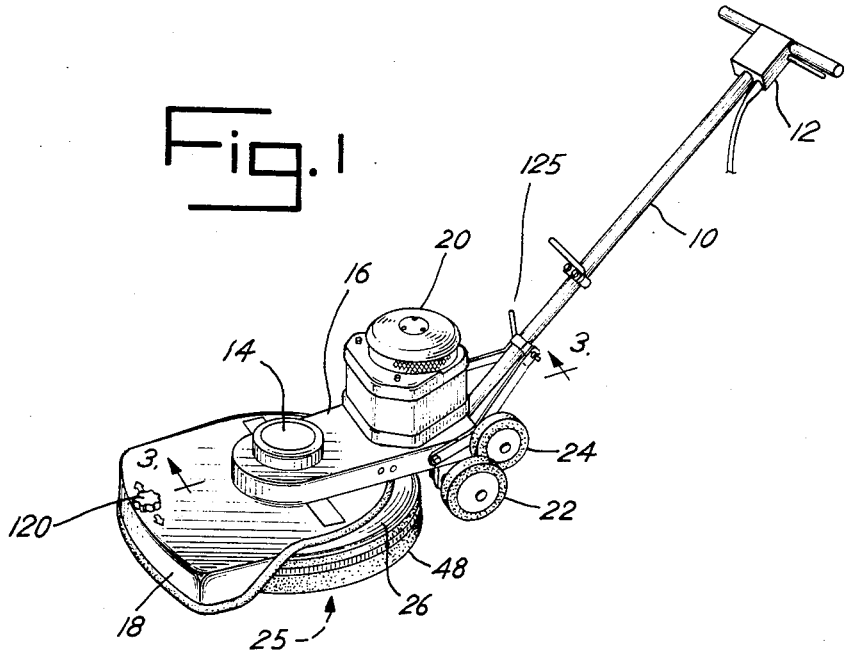
FIG. 1 is a perspective view of the machine constructed in accordance with the invention.
Figure 2:
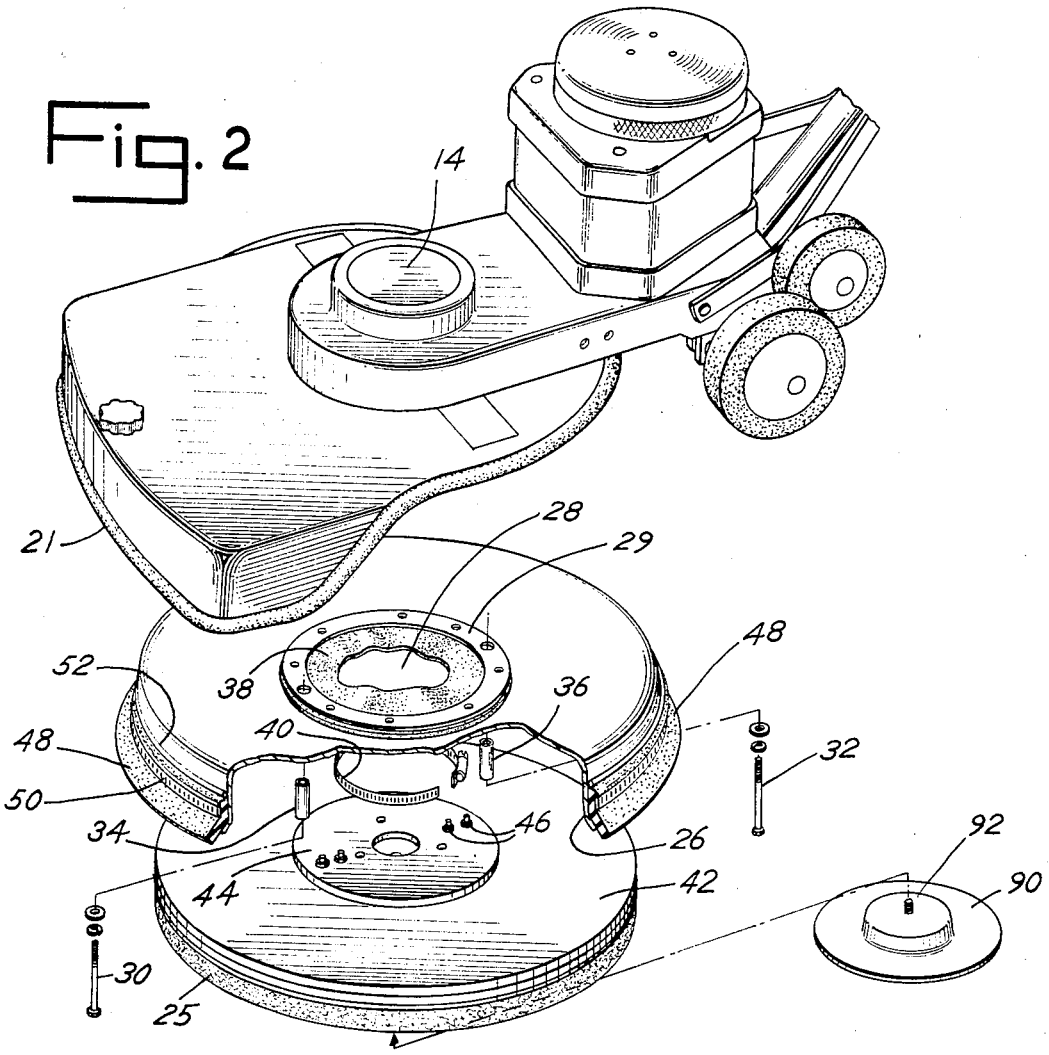
FIG. 2 is an exploded perspective view of the operating elements of the machine showing the base, the separate floating housing with the rubber resilient skirt, the top sealing diaphragm, the disc driving assembly, the burnishing disc and center disc holder cup.
Figure 3:
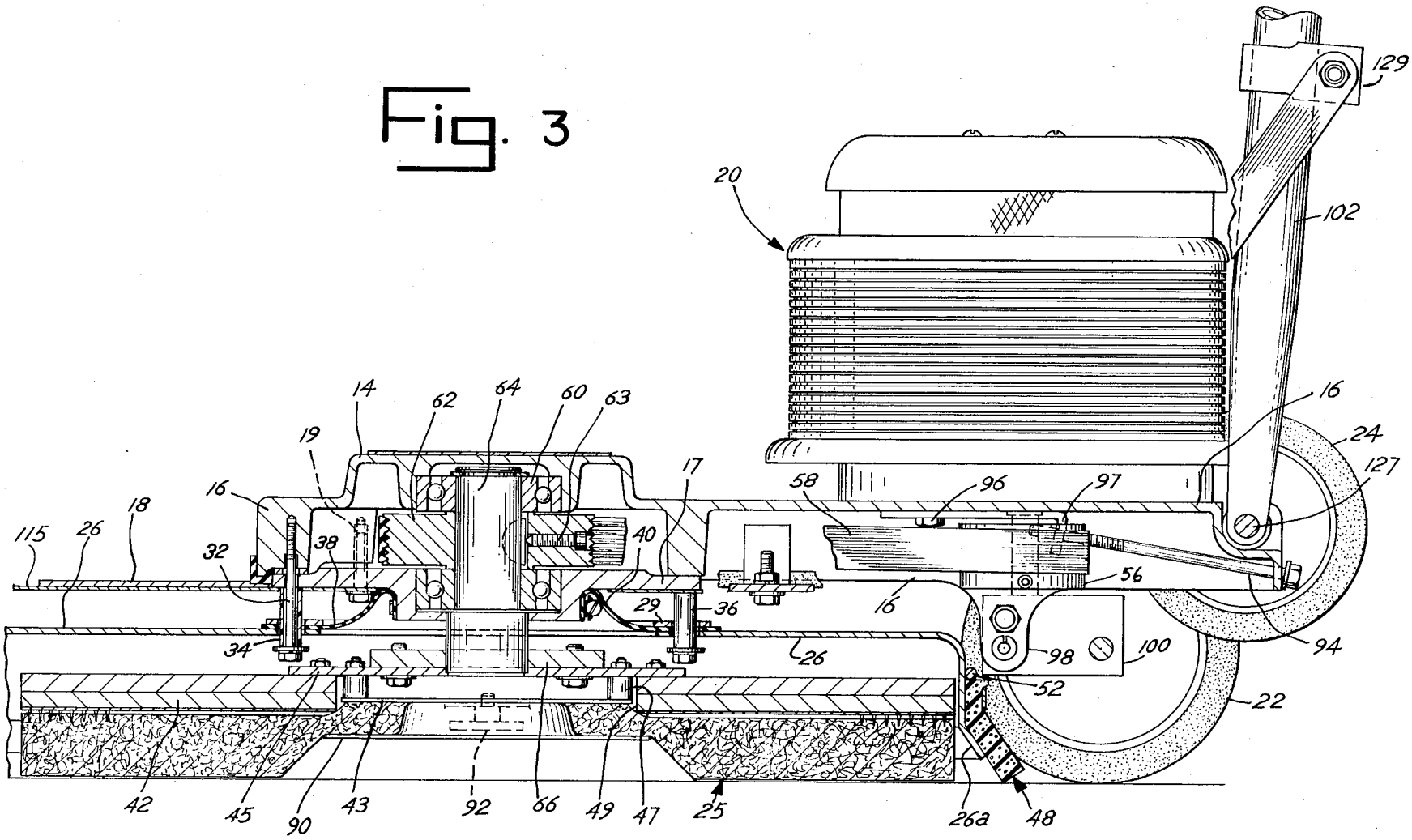
FIG. 3 is a longitudinal section through the operating portion of the machine showing means for completely enclosing the disc.
Figure 4:
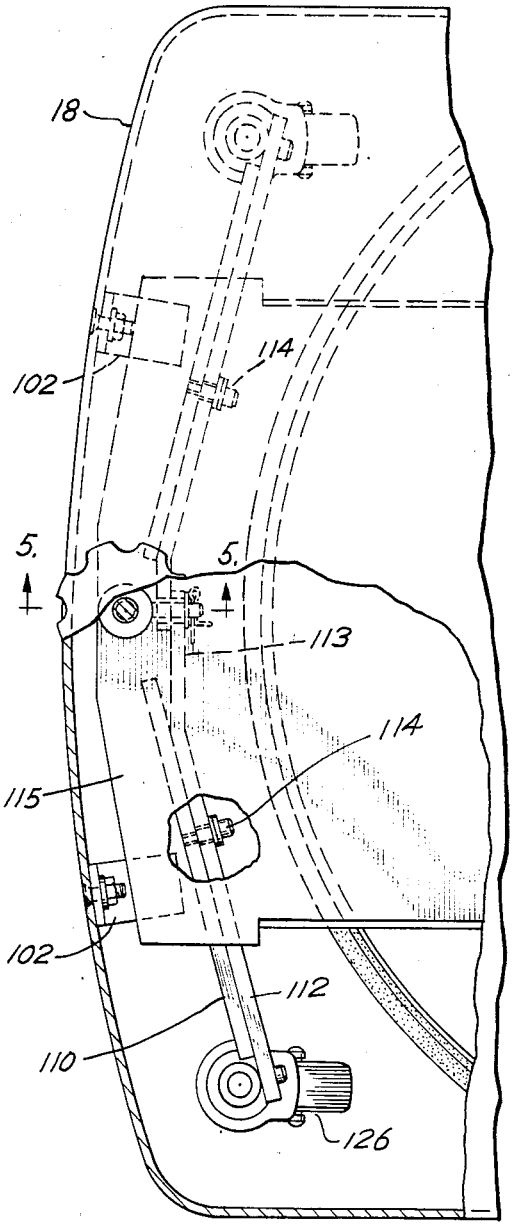
FIG. 4 is a plan view of the front of the machine partially broken away to show the swivel casters and their vertically adjustable linkages.

Referring to FIG. 1, the burnishing machine has a base frame 16 to which a handle 10 is secured having a control switch 12 at the upper end for manipulation by the operator. The base is a rigid metal casting. The machine is supported at the rear by wheels 22 mounted on an axle which is secured to the base 16 as explained in more detail below. A shroud 18 is bolted to the base 16 and carries a pair of swivel casters to support the front of the machine as shown in FIG. 4. A shaft 64, as shown in FIG. 3, is rotatably mounted in bearings inside the dome 14 of the casting. A burnishing disc driving assembly 42, as shown in FIG. 2, is secured to the end of the shaft and drives the separately attached disc 25 through spines projecting from the underside of the assembly 42. A motor 20 is mounted on the base 16 and drives the rotating shaft 64 through a belt and a pair of pulleys. Referring to FIG. 2, the rotating disc secured to the underside of driving assembly 42 is completely enclosed in the separate housing 26 which has outwardly flaring sidewalls supporting the flexible skirt 48 made from closed cell sponge rubber.

A pair of auxilliary wheels 24 are provided to facilitate balancing the machine when the buffing portion is tilted up out of engagement with the floor by pushing down on the handle 10. The machine is tilted for servicing and to facilitate storage. The wheels 24 also facilitate moving the burnisher up and down stairways.

The rotating shaft 64 (FIG. 3) terminates at its lower end in an integral flanged hub 66. An annular ring 45 is bolted to the disc driving assembly 42 which in turn is bolted to the flanged hub 66. The disc driving assembly face plate 42 has projecting fingers or spines to lock into the burnishing disc 25. The driving assembly has a central opening 49 to accommodate the attaching bracket or bar 43 which is also bolted to the ring 45 in spaced relation to the ring. The removable burnishing disc 25 is placed on the projecting fingers of member 42 and locked in place by means of a dished plate 90 and a wing bolt 92 which screws into a threaded center hole in the bar 43.

To close off the space surrounding the shaft 64 a rubber boot or membrane 38 is bolted to the top of the housing 26 by a ring 29. The inner circumference of the boot 38 is clamped with adjustable clamp 40 to the boss on plate 17 which in turn is bolted to the main base 16 by bolts 19. In conjunction with the domed portion 14 of the casting, plate 17 provides a mounting for the bearings 60 in which the shaft 64 rotates. A pulley 62 is keyed to the shaft 64 and is locked with set screw 63. A belt 58 is trained on the pulley 62 and at its opposite end around another pulley 56 which is secured to the end of the motor shaft. The motor is mounted on the base 16 by means of bolts 96 which extend through elongated slots in the base. Bolts 96 also extend through a pair of brackets 97 on the underside of the base 16. Long bolts 94 screw into the downturned ends of the brackets 97 for moving the motor back and forth in the elongated slots to tighten or loosen the belt 58.

Figure 5:
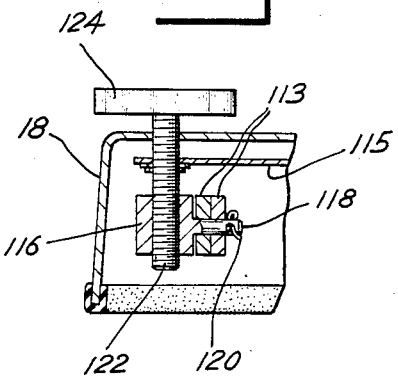
FIG. 5 is a sectional view taken along the line 5—5 of FIG. 4.

A subframe 115 (FIGS. 3 and 4) extend forwardly from the base frame 16 to which it is bolted by the series of bolts 19. The front of the subframe 115 carries a pair of brackets 102 to which the shroud 18 is bolted at its front end. A pair of swivel casters 126 are mounted on arms 112 which in turn are pivotally linked at 114 on bars 110 which are welded to the subframe 115. The inner ends 113 of the arms 112 overlap at the center line of the machine and contains bores to facilitate mounting the inner ends on a stub shaft 118 as best shown in FIG. 5. Shaft 118 projects from a threaded sleeve 116 which is screwed onto the end of a screw 122 rotatably mounted on the subframe 115. The top of the screw 122 projects through the shroud 18 and terminates in a knob 124 to facilitate turning the screw. As the screw is turned, the shaft 118 is raised or lowered thus causing the arms 112 to pivot about point 114 thereby raising or lowering the casters 126 mounted on the ends of the arms 112. This adjustment facilitates raising or lowering the disc driving assembly and connecting mechanism to the shaft 64 and motor 20 for the purpose of increasing or decreasing the frictional forces applied to the floor without interfering with the downward weight of the housing 26 and skirt 48. The housing 26 has a circumferential bead 52 (FIG. 2) against which the top of the sponge rubber skirt 48 abuts. A circumferential clamp 50 compresses the top of the skirt against the surface of the outwardly flaring lower rim **26*a* of the sidewall of housing 26. The clamp is readily removable to facilitate replacing the skirt 48** when it becomes worn.

In order to confine the outflow of air and particulate material which is generated as the burnishing disc rotates, it is necessary to keep the resilient skirt 48 in contact with the floor at all times, whether the floor is level or whether it is uneven. For this purpose, the floating mount on the bolts 30, 32 is provided. When the lower edge of the spong rubber resilient skirt moves over an uneven surface, the entire housing 26 is lifted or lowered as it slides over the surface of the plastic sleeves 34, 36 surrounding the bolts 30, 32. Holes cut in diaphragm 38 fit snuggly around sleeves 34, 36 and thus act as movable seals to prevent air from entering around sleeves 34, 36. The sponge rubber resilient skirt, of course, can be compressed and should be compressed slightly. Compression is achieved by making the housing 26 sufficiently heavy so that it bears against the skirt by reason of its carefully determined weight, requiring no springs or downward-forcing linkages. The ideal suspended weight for this preferred 20 inch diameter burnisher has been found to be in the range of 14 to 18 pounds, although heavier weights up to 26 pounds can be tolerated. However, the extra weight adds to the effort required to move the burnisher and increases the rate of wear on the skirt. The downward force relationships between the suspended weights and the circumference of the skirt bearing against the floor is between 0.19–0.25 pounds per linear inch and can range up to 0.36 pounds per linear inch without causing the resilient skirt to collapse. Since the housing 26 is mounted on two bolts, it can move not only vertically, but it also can tilt while at the same time remaining horizontally in proper juxtaposition to the rotating disc driving assembly within. Thus, regardless of where the unevenness of the floor occurs around the circumference of the housing, the housing can move to accommodate the unevenness, while all the time allowing the skirt to remove in contact with the surface of the floor.

The flare of the skirt 48 and supporting rim **26*a* ensures that the skirt lip does not turn under and bear against the outer edge of the rotating burnishing disc. The section of the sponge skirt 48 which extends below the lower rim 26*a* of the supporting ring is also critical to the operation. The ideal starting extension for a new skirt is in the range of ½ to ⅝ inch. This allows for a practical wearing down to roughly half of this extension. Extending the skirt beyond ⅝ inch increases the probability for "turn under" and also for the skirt to flare excessively causing the lower rim 26*a*** of the steel support ring to rub against the floor.

The sponge rubber skirt characteristics and dimensions have been found to be critical to provide the proper balance between (a) conformability to the floor surface and (b) stiffness to support the weighted housing, and (c) resistance to wear. The preferred material has been found to be a closed cell Buna 'N' sponge rubber, skin finish two sides; soft density; S.C.E.—41 per A.S.T.M test method D1056; ½ inch in thickness. The preferred dimension circumferentially is slightly undersized (8–12% less) with respect to the circumference of the flared lower rim **26*a* of the housing 26. The preferred width of the sponge skirt 48 has been found to be in the range of 2½ to 2⅝ inch. The outward flare angle to the vertical of the lower side wall section of the weighted housing 26** has been found to be preferably between 50° and 35°.

Wheels 22 are mounted on a shaft extending through blocks 100 bolted to bosses 98 cast as part of the base 16. Auxiliary wheels 24 are mounted on shaft 127 journaled in bearings comprising part of base 16. The handle 10 is pivotally mounted on the same shaft. The handle is free to move up or down vertically while in operation. The locking mechanism 125 is only used to fix the handle when tilting it back for transporting the machine on wheels 22 and 24.

It will be noted that the space around the rotating disc is completely enclosed. The rubber skirt 48 seals the circumference against the floor and the rubber diaphragm 38 closes off the opening around the rotating shaft 64 and also around the sleeves 34, 36 on bolts 30, 32. As a result moving air, resulting from rotation of the disc, cannot pass out into the room where the machine is being operated and air cannot be drawn in through the top. The parts of the drive assembly below shaft 64 are preferably designed with smooth surfaces to minimize frictional forces within which would increase its tendency to act as a centrifugal fan impeller which in turn would cause weight to be added to the housing.

Figure 6:
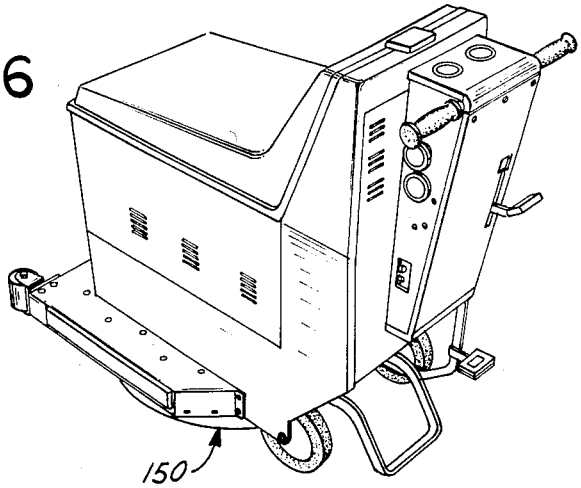
FIG. 6 is a perspective view of a battery-powered burnisher having an air restraint enclosure constructed in accordance with the invention.
Figure 7:
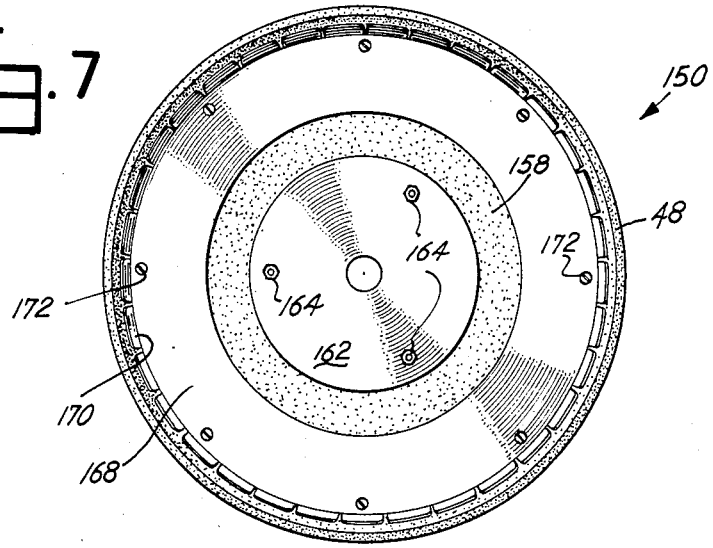
FIG. 7 is a plan view of the underside of the air restraint enclosure on the burnisher of FIG. 6.
Figure 8:
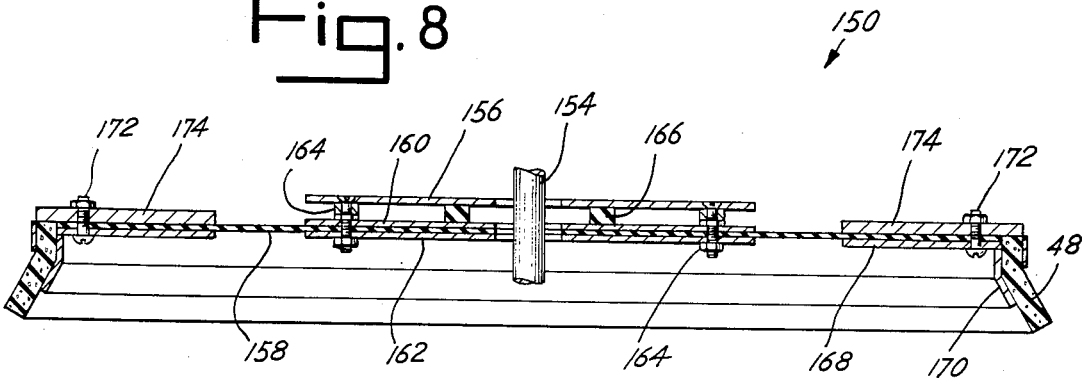
FIG. 8 is a sectional elevational view through the enclosure of FIG. 7.

A modification of the invention is shown in FIGS. 6–8. In this version, the burnisher is powered by a rechargeable battery. It is much more sturdily constructed to support the weight of the storage battery. The machine 150 is supported by two rather large wheels at the rear and two caster wheels at the front. Forward of the casters outside the shroud are bumper rollers 152. This machine, except for the specialized parts necessary to the functioning of the invention, is available commercially from Advance Machine Co. of Spring Park, MN, as the Whirlamatic 2000.

Referring to FIGS. 7 and 8, drive shaft 154 extends downwardly directly from the motor (not shown) through plate adapter 156 which is bolted to the motor base. A fabric reinforced rubber diaphragm 158 is sandwiched between mounting plates 160, 162 secured in spaced relation to adapter plate 156 by means of bolts and locking nuts 164. A rubber gasket 166 seals the opening between the adapter plate 156 and the upper mounting plate 160. The diaphragm fits snuggly around the drive shaft 154 to prevent air from flowing past the shaft.

The air restraint enclosure is mounted on the periphery of the flexible diaphragm 158. A ring 168 having a downwardly-turned flared flange 170 is bolted at 172 to the diaphragm with the cooperation of a weight flange 174. The sponge rubber skirt 48 is secured at its top margin to the flange 170 by means of the removable clamp 50 as previously described in connecting with the first embodiment. To facilitate manufacture of the ring 168, the flange 170 may be slit at regular intervals around the entire circumference. The burnishing disc and disc driving assembly are mounted on the drive shaft 154 in the same manner as in the first embodiment. The upper surface of the hub of the disc driving assembly is smooth to minimize air turbulence within the enclosure.

From the foregoing description, it will be apparent that the skirt 48 and connecting parts are free to float vertically and horizontally by reason of the flexible mounting through diaphragm 158. The dimension of this flexible diaphragm and the nature of the reinforced rubber sheeting are preferably as follows. The sheeting must be sufficiently flexible to permit vertical movement of the skirt 48 smoothly and uniformly against the floor being traveled. At the same time, it must resist horizontal displacement to the extent that the flange 170 must not come into contact with the spinning disc and drive assembly. A satisfactory diaphragm material is 1/16 inch thick SBR rubber with polyester fabric reinforcing no. 41 (ASTM 2102.01). The preferred area relationship of the exposed rubber diaphragm to the flat upper surfaces of the mounting flange 160 and the outer (weighted) sponge skirt supporting component 174 ranges from 1:3.2 to 1:3.8, more particularly 1:3.5.

The weight of the sponge rubber skirt assembly is the same as that indicated for the first modification: 14–18 pounds, 25 pounds maximum or 0.19–0.25 pounds per linear inch of skirt circumference.

What is claimed is:

1. In an ultra high speed floor burnishing machine comprising a base, wheels supporting said base, a burnishing disc mounted on a shaft depending from the base, and a motor above the base for driving said disc through said shaft, the improvement comprising a separate housing beneath said base completely enclosing said disc, said housing comprising an outwardly flaring domed flange surrounding said disc, a resilient skirt secured to said flange and extending below the lower edge of said flange for engaging the floor, an opening in the top of the housing through which said shaft extends, a flexible diaphragm sealing said opening around said shaft, and means for suspending said housing from said base which permits the housing to float in response to unevenness in the floor level, said domed flange being weighted to compress the resilient skirt to prevent air from leaking past the resilient skirt as it moves over irregular floor surfaces.

2. The machine of claim 1 in which said wheels include a pair of swivel casters at the front of said base, a pair of arms pivotally mounted between their ends on said base, said casters being mounted on the outer ends of said arms, the inner ends of said arms being connected to a vertically adjustable pin extending through the base, and a handle on said pin for rotating the arms about their pivot points to raise or lower the casters dependent on the frictional forces involved in the floor burnishing process.

3. The machine of claim 1 in which said resilient skirt is made from a soft closed cell rubber.

4. The machine of claim 1 in which said housing suspension means comprises two bolts vertically extending through the housing and screwed into said base, and a plastic sleeve on each bolt over which the housing slides as it moves up and down.

5. The machine of claim 4 in which said sleeves are externally sealed against flow of air by said flexible diaphragm.

6. The machine of claim 4 which includes a disc driving assembly connecting said disc to said motor, the portion of said assembly within said housing having relatively smooth surfaces to minimize centrifugal action which would increase air flow into or out of the space enclosed within said housing.

7. The machine of claim 1 in which said outwardly flaring flange has a circumferential bead at the top against which the top of said resilient skirt abuts.

8. The machine of claim 1 in which said outwardly-flaring flange is disposed at an angle of 25° to 35° from vertical.

9. The machine of claim 1 in which the weight compressing said skirt averages from 0.19 to 0.25 pounds per linear inch of skirt circumference.

10. The machine of claim 1 in which said suspending means comprises said flexible diaphragm.

11. The machine of claim 10 in which said diaphragm is fixed in its central area to said base and said outwardly-flaring domed flange is secured to the marginal area of said diaphragm at its circumference, the annular space between said central area said marginal area providing said suspending means.

12. The machine of claim 11 in which the area of said annular space to the sum of said central area plus said marginal area is in the ratio of 1:3.2 to 1:3.8.

* * * * *